US008707601B1

(12) United States Patent
Kirk

(10) Patent No.: US 8,707,601 B1
(45) Date of Patent: Apr. 29, 2014

(54) INDICATOR LIGHT FOR FILMING

(71) Applicant: John Kirk, Shallow Lake (CA)

(72) Inventor: John Kirk, Shallow Lake (CA)

( * ) Notice: Subject to any disclaimer, the term of this patent is extended or adjusted under 35 U.S.C. 154(b) by 0 days.

(21) Appl. No.: 13/804,801

(22) Filed: Mar. 14, 2013

(51) Int. Cl.

| | |
|---|---|
| ***F41A 9/53*** | (2006.01) |
| ***F41C 27/00*** | (2006.01) |
| ***G08B 5/00*** | (2006.01) |
| ***G08B 5/22*** | (2006.01) |
| ***G08B 5/36*** | (2006.01) |

(52) U.S. Cl.
CPC . *F41C 27/00* (2013.01); *G08B 5/00* (2013.01); *G08B 5/223* (2013.01); *G08B 5/36* (2013.01)
USPC ..... 42/1.01; 42/106; 340/4.2; 340/6.1; 340/6.11; 340/7.61; 340/815.4

(58) Field of Classification Search
CPC ..... F41C 27/00; G08B 5/00; G08B 5/223; G08B 5/36
USPC ..... 42/1.01, 106; 340/4.2, 6.1, 6.11, 7.61, 340/332, 815.4
See application file for complete search history.

(56) References Cited

U.S. PATENT DOCUMENTS

| | | | | |
|---|---|---|---|---|
| 6,305,941 | B1 | 10/2001 | Kotsiopoulos | |
| 6,759,966 | B1 | 7/2004 | Weng | |
| 8,093,992 | B2 * | 1/2012 | Jancic et al. | 340/12.5 |
| 8,203,445 | B2 | 6/2012 | Recker et al. | |
| 8,387,294 | B2 * | 3/2013 | Bolden | 42/1.01 |
| 2006/0042142 | A1 * | 3/2006 | Sinha | 42/1.01 |
| 2007/0195544 | A1 | 8/2007 | Graves, Jr. | |
| 2008/0112698 | A1 * | 5/2008 | Ray | 396/56 |
| 2012/0169881 | A1 * | 7/2012 | Saunders et al. | 348/157 |
| 2012/0174525 | A1 * | 7/2012 | Hinshaw et al. | 52/741.1 |

* cited by examiner

*Primary Examiner* — J. Woodrow Eldred
(74) *Attorney, Agent, or Firm* — Robert C. Montgomery; Montgomery Patent & Design

(57) ABSTRACT

An indicator light for filming is provided having a button wirelessly coupled to an illumination device. The button is placed on a camera while the illumination device is placed on the barrel of a gun. The button is depressed on the camera to indicate that the shooter is free to take the shot.

20 Claims, 8 Drawing Sheets

INDICATOR LIGHT FOR FILMING

RELATED APPLICATIONS

Not applicable.

FIELD OF THE INVENTION

The present invention relates generally to alerting system further including an indicator light assembly adapted to be mounted to a firearm, a switch adapted to be mounted to a recording device; and a wireless communication between the indicator light assembly and switch.

BACKGROUND OF THE INVENTION

Hunting is a sport that requires stealth. Documentation of sporting events, especially through pictorial and video recording, requires communication and coordination. Communicating and coordinating with others while maintaining a stealthy composure proves to be difficult in most situations. The two (2) activities tend to be mutually exclusive, forcing those engaging in such activities concurrently to exercise discretion as to when to exploit the effects of one activity and when to compromise the effects of the other. Most sports do not require the level of stealth associated with hunting, making it extremely difficult for a documenter to coordinate with the hunter or even have the hunter telegraph his intentions. It is similarly difficult for a hunter to know if the documenter has obtained a vantage point of view to adequately record the hunter's actions before the hunter takes such action.

Current methods of communication between a hunter and a documenter are conducted through voice commands and hand signals. Both methods compromise a hunter's stealthy composure and are limiting in that the documenter must be within an adequate range of sight/acoustics for such communications to be effective. Other methods of distant communication either further compromise stealth or are cost-prohibitive. It is desirous to have a device to enable a hunter and documenter to covertly communicate in order to achieve proper documentation of the hunter's hunt. It would be beneficial for this device to be of light-weight, compact, retrofittable to existing equipment, and cost effective.

SUMMARY OF THE INVENTION

The present invention relates to an indicator light and signaling system for covert communication between a hunter and a documenter while performing documentation through filming. The system comprises a camera button assembly and an indicator light assembly. The camera button assembly further comprises of a plate, a bottom surface, a first set of internal electrical components, a battery, and a signal transmitter. The bottom surface is provided with a first fastening means. The indicator light further comprises of a translucent dome, a light source, a base, a second set of internal electrical components, a battery, and a signal receiver. The base is further provided with a second fastening means.

The camera button is attached to an existing camera of the documenter. The indicator light is removably attached to an existing firearm. The documenter depresses the camera button thereby emitting a wireless signal. The indicator light receiver detects the signal and converts it to electrical current to illuminate the light source. The illuminated light informs the hunter that the documenter is in a proper position and is ready to record a hunter's action. A second embodiment is to have an indicator light without a base and to have the indicator light embedded into a rifle scope. A third embodiment is to have a remote hand-held signal transmitter as the camera button rather than having the button affixed to a side of a camera.

Hunters and documenters wishing to document the sport of hunting through pictorial and video recording techniques must have a means to communicate and coordinate activities without compromising the stealthy composure of the hunter. This means of communication should be simplistically effective and covert, in that the hunter's prey should not be alerted or aware of such communication. The development of the present invention fulfills that need.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
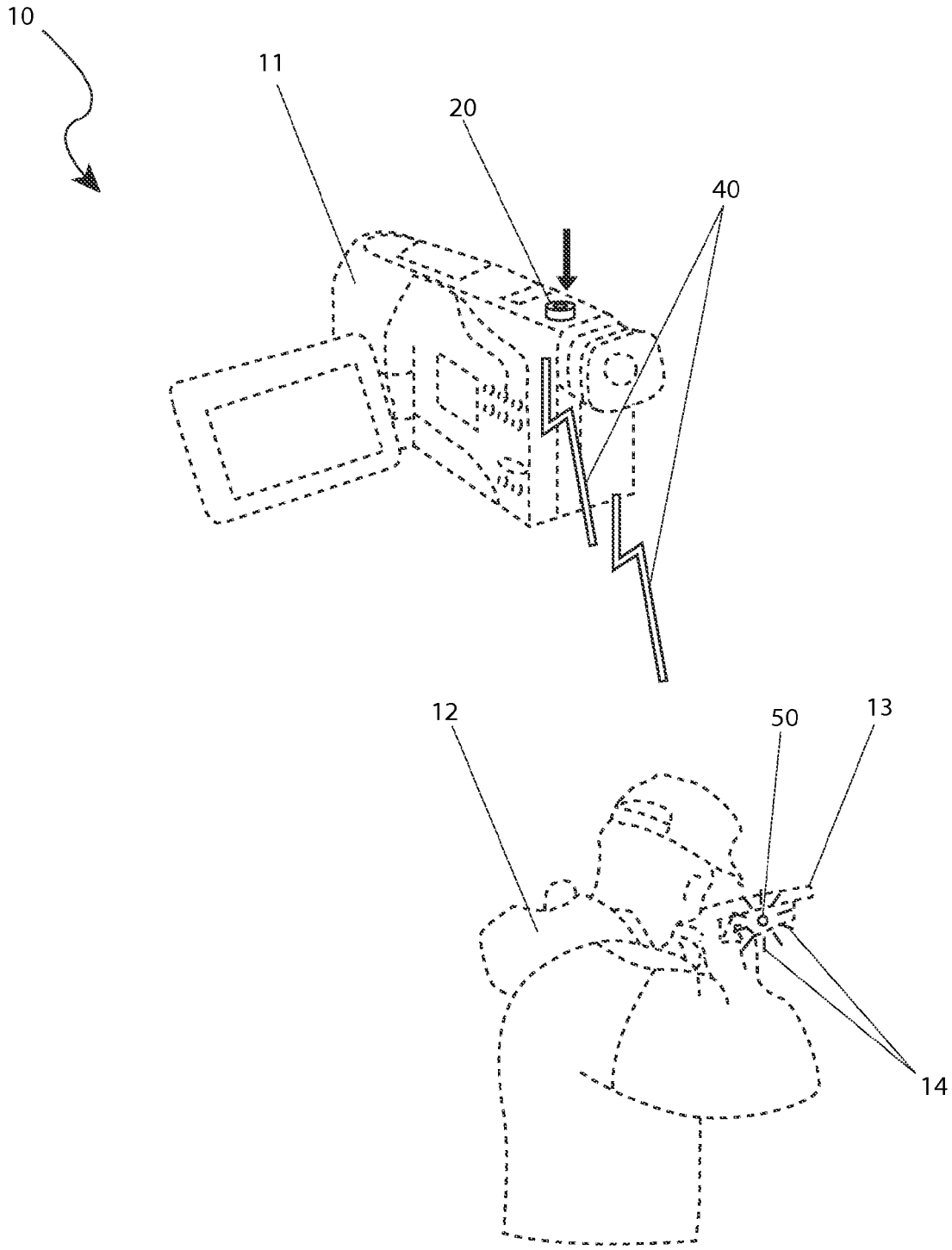
FIG. 1 is an environmental view of an indicator light for filming 10, according to a preferred embodiment of the present invention.
Figure 3:
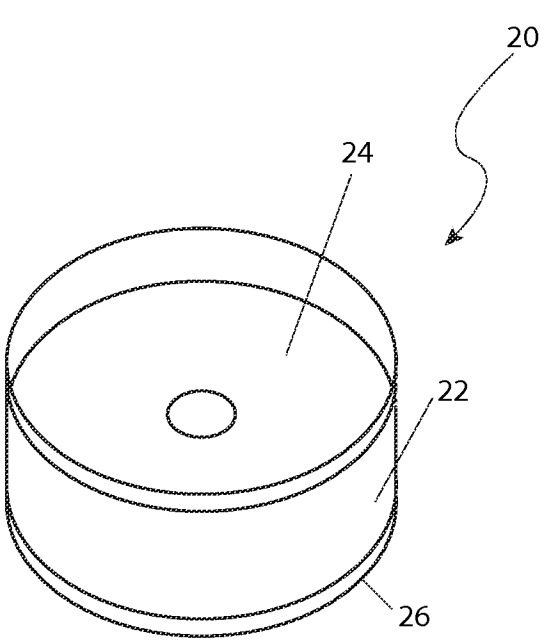
FIG. 3 is another upper perspective view of the camera button 20 depicting a depressed state, according to a preferred embodiment of the present invention.
Figure 2:
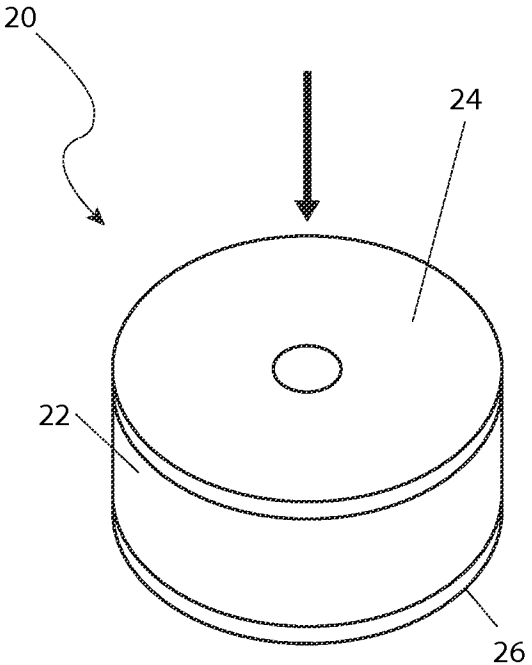
FIG. 2 is an upper perspective view of a camera button 20, according to a preferred embodiment of the present invention.
Figure 5:
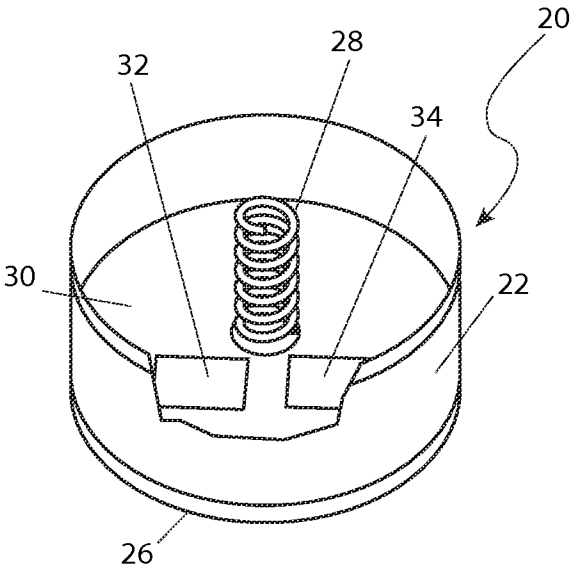
FIG. 5 is a broken away perspective view of the camera button 20, according to a preferred embodiment of the present invention.
Figure 4:
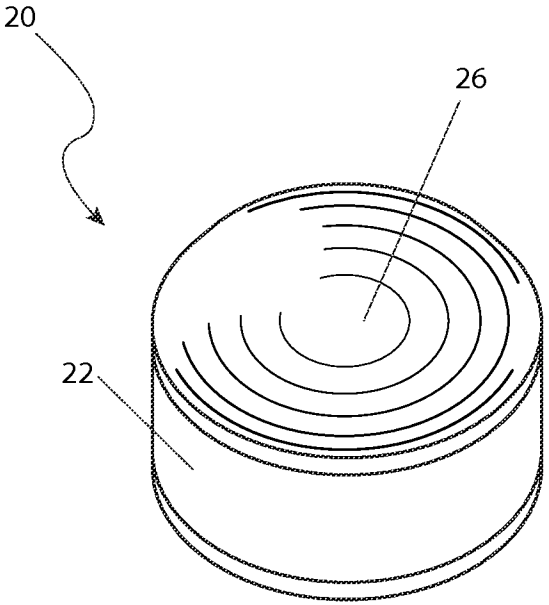
FIG. 4 is a bottom perspective view of the camera button 20, according to a preferred embodiment of the present invention.

10 indicating light for filming
11 camera
12 hunter
13 existing firearm
14 illumination
20 camera button
22 body
24 plate
26 bottom surface
28 spring
30 camera button circuitry

32 camera button battery
34 transmitter
40 signal
50 indicator light
52 dome
54 base
56 slot
58 light-emitting diode
60 indicator light battery
62 receiver
64 strap
66 fastener
70 alternate embodiment
72 purchased firearm
74 scope
76 alternate indicator light
80 remote
82 remote switch
84 aperture
86 key ring

DETAILED DESCRIPTION OF THE PREFERRED EMBODIMENT

Figure 8:
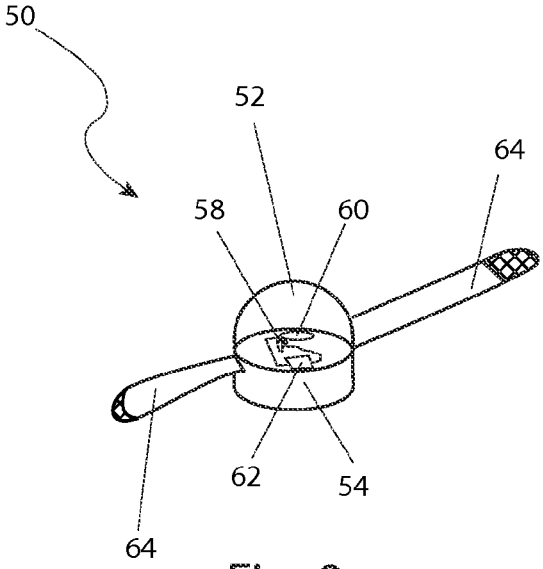
FIG. 8 is another perspective view of the indicator light 50 depicting placement of the strap 64, according to a preferred embodiment of the present invention.
Figure 9:
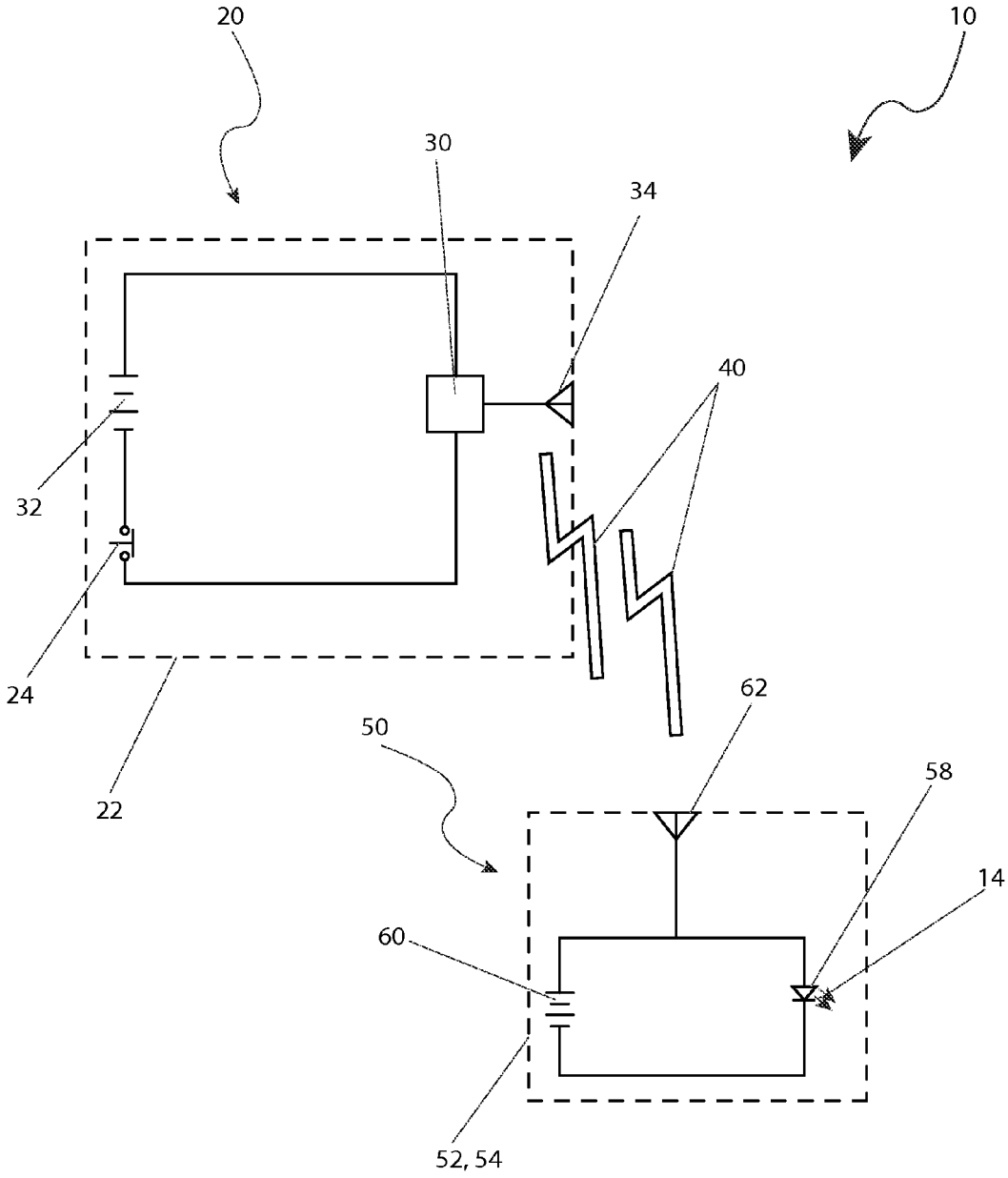
FIG. 9 is an electric block diagram of the indicator light for filming 10, according to a preferred embodiment of the present invention.
Figure 10:
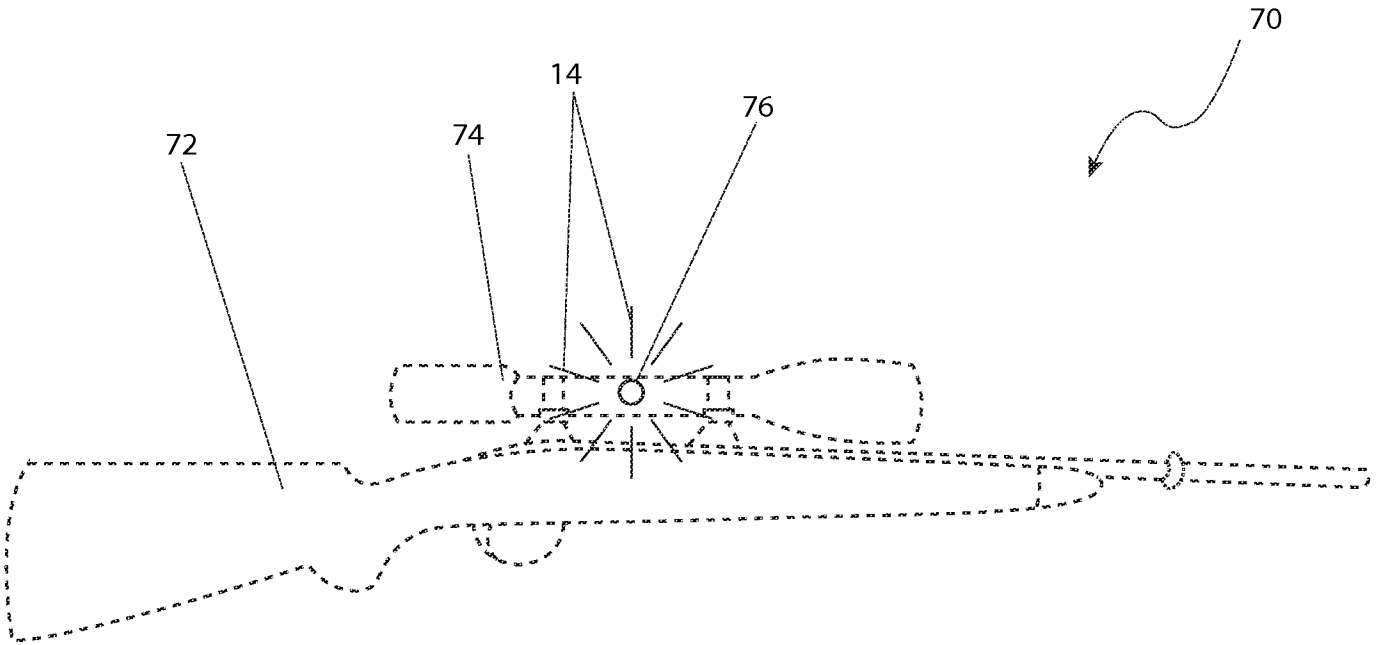
FIG. 10 is a side view of an alternate indicator light 76, according to an alternate embodiment 70 of the present invention.
Figure 11:
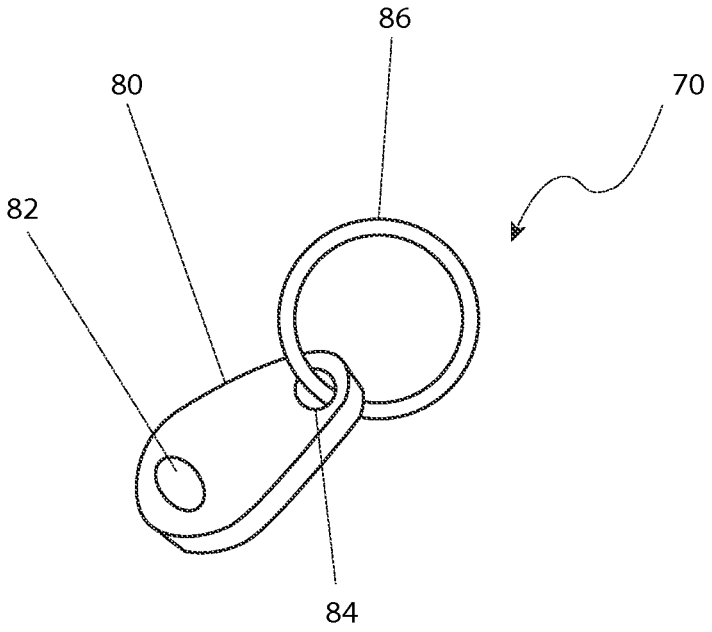
FIG. 11 is a perspective view of a remote 80, according to an alternate embodiment 70 of the present invention; and, FIG. 12 is an electric block diagram of the alternate indicator light 76, according to an alternate embodiment 70 of the present invention.
Figure 12:
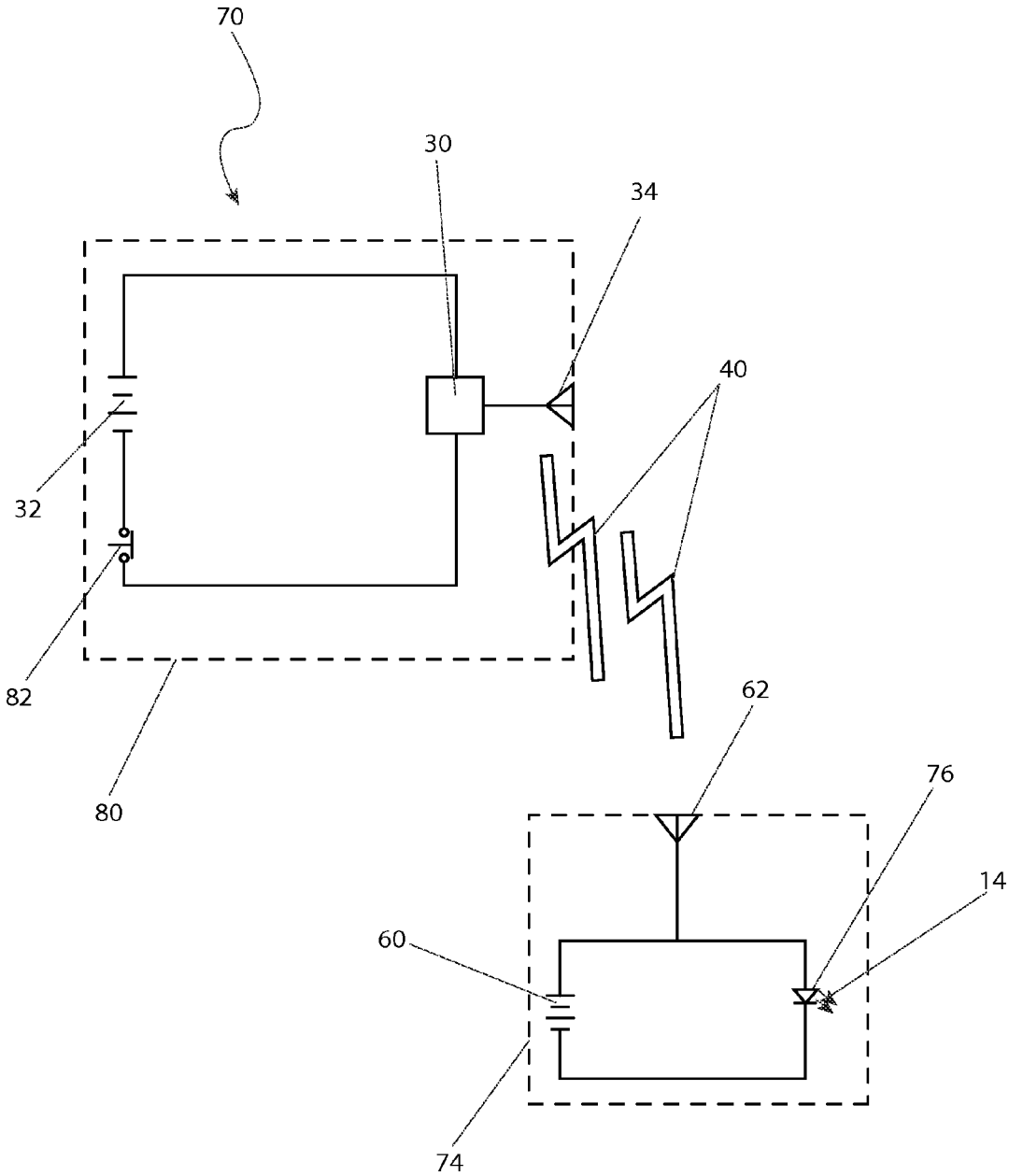

In accordance with the invention, the best mode is presented in terms of the described embodiments, herein depicted within FIGS. 1 through 9 and alternately within FIGS. 10 through 12. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the"" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

The present invention describes an indicating light for filming (herein described as the "system") 10, which provides a wireless signaling apparatus to alert a hunter 12 that a potential game target is being recorded by a camera 11. In other words, the system 10 enables a camera operator to inform a hunter 12 that the hunted game is in the camera's 11 frame and the hunter 12 may take the a shot and it will be recorded by the camera 11.

Referring now to FIG. 1, an environmental view of the system 10, according to the preferred embodiment of the present invention, is disclosed. The system 10 comprises a camera button 20 and an indicator light 50. The camera button 20 is attached to an existing camera 11 or other similar video recording device. The indicator light 50 is removably attached to an existing firearm 13 in a location that easily is seen by the hunter 12. In use when the camera button 20 is activated a signal 40 is sent to the indicator light 50 to visually inform the hunter 12 via an illumination 14 that a shot may be taken and said shot will be video recorded.

Referring now to FIGS. 2 through 5, various views of the camera button 20, according to the preferred embodiment of the present invention, are disclosed. The camera button 20 comprises a cylindrical body 22 further comprising a plate 24, bottom surface 26, and internal electrical components. The plate 24 provides an operating means to the camera button 20. The plate 24 operates via a spring 28 which enables the camera button 20 to activate and transmit the signal 40 to the indicator light 50. The spring 28 is attached to camera button circuitry 30 which electrically interconnects the spring 28 to a camera button battery 32 and a transmitter 34. The camera button circuitry 30 is comprised of a printed circuit board which retains the camera button battery 32 and the transmitter 34. The camera button battery 32 is preferably a long lasting disc-type battery which supplies the camera button 20 with current to operate. The transmitter 34 preferably utilizes radio frequencies to transmit the signal 40, yet it is known that other communication signals may be utilized without limiting the scope of the invention.

A bottom surface 26 of the body 22 of the camera button 20 includes a fastening means such as a tacky surface, magnetic surface, or the like which either permanently or temporarily attaches the camera button 20 to the camera 11.

Figure 6:
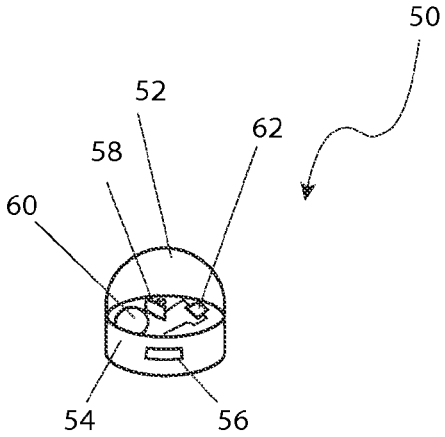
FIG. 6 is an upper perspective view of an indicator light 50 according to a preferred embodiment of the present invention.
Figure 7:
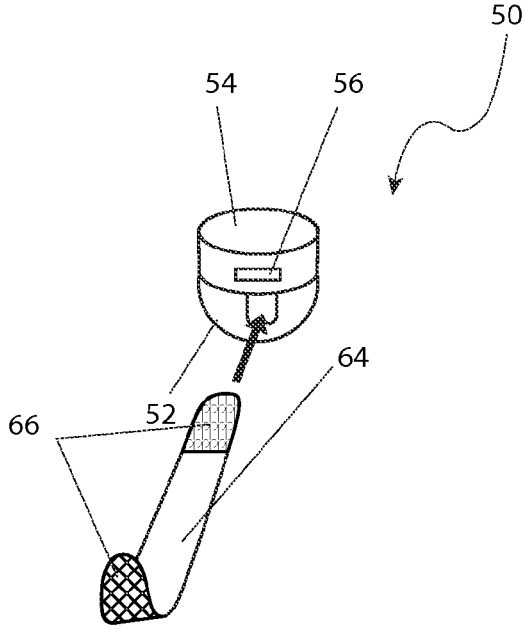
FIG. 7 is a bottom perspective view of the indicator light 50 depicting a strap 64, according to a preferred embodiment of the present invention.

Referring now to FIGS. 6 through 8, various views of the indicator light 50, according to the preferred embodiment of the present invention, is disclosed. FIG. 6 depicts an upper perspective view of the indicator light 50, FIG. 7 depicts a bottom perspective view of the indicator light 50 depicting the strap 64, and FIG. 8 depicts another perspective view of the indicator light 50 depicting placement of the strap 64. The indicator light 50 comprises a dome 52, a base 54, and other electrical components. The dome 52 enables illumination 14 of a light-emitting diode 58 to shine through, thereby alerting the hunter 12. The dome 52 is preferably fabricated from a translucent plastic and is integral to the base 54. The base 54 is cylindrical and is preferably comprised of a magnetic material which enables the indicator light 50 to be removably attached to a magnetic portion of the existing firearm 13. The base 54 also comprises a pair of opposing slots 56. The slots 56 enable a textile strap 64 to be inserted. Opposing end portions of the strap 64 include a fastener 66 such as a hook-and-loop fastener which enables the strap 64 to encompass and fasten around a desired item or portion of the existing firearm 13 in lieu of utilizing the magnetic base 54. The width of the strap 64 is slightly smaller than the inner width of the slots 56 to enable insertion.

Within the base 54 are the light-emitting diode 58, an indicator light battery 60, and a receiver 62. The light-emitting diode 58 is a common light source which creates an illumination 14 when the signal 40 is received by the receiver 62. The indicator light battery 60 is similar to the camera button battery 32 and supplies current to the indicator light 50. The receiver 62 intercepts the radio frequency signal 40 sent by the transmitter 34 and converts the signal 40 to the illumination 14 of the light-emitting diode 58, thereby visually alerting the hunter 12.

Referring now to FIG. 9, an electric block diagram of the system 10, according to the preferred embodiment of the present invention, is disclosed. When the plate 24 is depressed on the camera button 20, current is sent via the camera button battery 32 to the transmitter 30 to transmit the signal 40. The receiver 62 intercepts the signal 40 and the light-emitting diode 58 illuminates 14 and alerts the hunter 12.

Referring now to FIG. 10, a side view of the alternate indicator light 76, FIG. 11, a perspective view of a remote 80, according to the alternate embodiment 70 of the present invention, and FIG. 12, an electrical block diagram of the alternate indicator light 76, are disclosed. An alternate embodiment 70 may also be manufactured enables a hunter 12 to purchase a firearm 72 which was manufactured with an alternate indicator light 76 upon a scope 74 which produces an illumination 14. The alternate indicator light 76 operates identical to the abovementioned indicator light 50 and comprises electrical components as abovementioned, yet does not include the base 54. The alternate embodiment 70 also includes a remote 80 which would be given to the camera operator. The remote 80 operates identical to the camera button 20 and comprises electrical components as abovementioned, but provides a handheld device including a remote switch 82 which activates the transmitter 34 to transmit the signal 40. The remote 80 also comprises an aperture 84 to attach a key ring 86, thereby enabling the remote 80 to be suspended from a desired item.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of utilizing the system 10 may be achieved by performing the following steps: acquiring the system 10; attaching the bottom surface 26 of the camera button 20 onto an accessible surface of a camera 11; attaching the indicator light 50 onto an existing firearm 13 via the magnetic base 54 or the strap 64; enabling the camera operator to depress the plate 24, thereby transmitting a signal 40 via the transmitter 34; enabling the receiver 62 to intercept the signal 40 and activate the light-emitting diode 58, thereby alerting the hunter 12 via the illumination 14 that the camera operator has the game in the frame and the shot may be executed; utilizing the system 10 as desired; and, providing the ability to easily capture the hunting process on camera 11, without the possibility of scaring the game away, in a manner which is not only quick, easy, and effective, but foolproof as well.

The alternate embodiment 70 of the present invention can be utilized by the common user in a simple and effortless manner with little or no training. After initial purchase or acquisition of the system 10, it would be installed as indicated in FIGS. 10 and 11.

The method of utilizing the alternate embodiment 70 may be achieved by performing the following steps: acquiring a purchased firearm 72 which comprises a scope including an alternate indicator light 76; acquiring the remote 80 and ensuring the camera operator is given the remote 80; enabling the camera operator to depress the remote switch 82, thereby transmitting the signal 40 via the transmitter 34; enabling the receiver 62 to intercept the signal 40 and activate the light-emitting diode 58, thereby alerting the hunter 12 via the illumination 14 that the camera operator has the game in the frame and the shot may be executed; utilizing the alternate embodiment 70 as desired; suspending the remote 80 via the key ring 86 as desired; and, providing the ability to easily capture the hunting process on camera 11, without the possibility of scaring the game away, in a manner which is not only quick, easy, and effective, but foolproof as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An indicating system, comprising:

a switch adapted to be attached to and in electrical communication with a recording device; and, an indicator light assembly adapted to be removably attached to a firearm;

wherein said switch is in wireless communication with said indicator light assembly;

wherein said switch generates and transmits a signal upon activation thereof by a first user;

wherein said indicator light assembly is adapted to be mounted within eyesight of a second user adjacent to said firearm; and, wherein said indicating light assembly energizes upon receipt of said signal and emits an alerting illumination.

2. The system of claim 1, wherein said switch comprises:

a cylindrical switch body, further having a bottom surface adapted to be removably attached to said recording device;

a plate located within said body and freely movable therein;

a spring attached to a lower surface of said plate and biasing said plate upwardly; and, a signal generating means in mechanical communication with said spring;

wherein depression of said plate enables said spring to contact said signal generating means to generate and transmit said signal.

3. The system of claim 2, wherein said signal generating means comprises:

a first power source;

a circuit board in electrical communication with said first power source; and, a transmitter in electrical communication with said first power source and said circuit board.

4. The system of claim 2, wherein said indicator light assembly further comprises:

an indicator body, having a generally cylindrical base member adapted to be removably attached to said firearm and a dome-shaped upper member extending outward from an upper perimeter of said base member;

a power source located within said base member;

an illumination means disposed within said base and extending into said upper member; and, a receiver located within said base member;

wherein said illumination means and said receiver are in electrical communication with said power source;

wherein said receiver is in wireless communication with said signal generating means and in electrical communication with said illumination means; and, wherein said illumination means is energized upon receipt of said signal and emits said alerting illumination through said upper member.

5. The system of claim 4, wherein said base comprises a pair of slots on opposing side walls for receiving an adjustable strap therethrough;

wherein said adjustable strap comprises a fastening means located on opposing distal ends thereof.

6. The system of claim 5, wherein said fastening means comprises a hook-and-loop fastener.

7. The system of claim 5, wherein said base further comprises a magnetic material.

8. The system of claim 7, wherein said illumination means further comprises a light-emitting diode.

9. An indicating system, comprising:

a switch adapted to be attached to and in electrical communication with a recording device; and, a firearm sight comprising an indicator light assembly adapted to be removably attached to a firearm;

wherein said switch is in wireless communication with said indicator light assembly;

wherein said switch generates and transmits a signal upon activation thereof by a first user;

wherein said indicator light assembly is adapted to be mounted within eyesight of a second user adjacent to said firearm; and, wherein said indicating light assembly energizes upon receipt of said signal and emits an alerting illumination.

10. The system of claim 9, wherein said switch comprises:

a cylindrical switch body, further having a bottom surface adapted to be removably attached to said recording device;

a plate located within said body and freely movable therein;

a spring attached to a lower surface of said plate and biasing said plate upwardly; and, a signal generating means in mechanical communication with said spring;

wherein depression of said plate enables said spring to contact said signal generating means to generate and transmit said signal.

11. The system of claim 10, wherein said signal generating means comprises:

a first power source;

a circuit board in electrical communication with said first power source; and, a transmitter in electrical communication with said first power source and said circuit board.

12. The system of claim 10, wherein said firearm sight further comprises:

a firearm sight body having a mount adapted to be removably attached to an upper portion of said firearm further having a sight located within said firearm sight body;

a power source located within said firearm sight body;

an illumination means disposed within a sidewall of said firearm sight body; and, a receiver located within said firearm sight body;

wherein said illumination means and said receiver are in electrical communication with said power source;

wherein said receiver is in wireless communication with said signal generating means and in electrical communication with said illumination means; and, wherein said illumination means is energized upon receipt of said signal and emits said alerting illumination.

13. The system of claim 12, wherein said illumination means further comprises a light-emitting diode.

14. An indicating system, comprising:

a switch adapted to be attached to and in electrical communication with a recording device;

a firearm sight comprising an indicator light assembly adapted to be removably attached to a firearm; and, a remote control in wireless communication with said indicator light assembly;

wherein said switch is in wireless communication with said indicator light assembly;

wherein said switch generates and transmits a switch signal upon activation thereof;

wherein said remote control generates and transmits a remote signal upon activation thereof by a first user;

wherein said indicator light assembly is adapted to be mounted within eyesight of a second user adjacent to said firearm; and, wherein said indicating light assembly energizes upon receipt of either said switch signal or said remote signal and emits an alerting illumination.

15. The system of claim 14, wherein said switch comprises:

a cylindrical switch body, further having a bottom surface adapted to be removably attached to said recording device;

a plate located within said body and freely movable therein;

a spring attached to a lower surface of said plate and biasing said plate upwardly; and, a signal generating means in mechanical communication with said spring;

wherein depression of said plate enables said spring to contact said signal generating means to generate and transmit said switch signal.

16. The system of claim 14, wherein said signal generating means comprises:

a first power source;

a circuit board in electrical communication with said first power source; and, a transmitter in electrical communication with said first power source and said circuit board.

17. The system of claim 14, wherein said firearm sight further comprises:

a firearm sight body having a mount adapted to be removably attached to an upper portion of said firearm further having a sight located within said firearm sight body;

a power source located within said firearm sight body;

an illumination means disposed within a sidewall of said firearm sight body; and, a receiver located within said firearm sight body;

wherein said illumination means and said receiver are in electrical communication with said power source;

wherein said receiver is in wireless communication with said signal generating means and in electrical communication with said illumination means; and, wherein said illumination means is energized upon receipt of either said switch signal or said remote signal and emits said alerting illumination.

18. The system of claim 17, wherein said illumination means further comprises a light-emitting diode.

19. The system of claim 14, wherein said remote control further comprises a hand-held device having a remote switch for generating said remote signal and a remote transmitter is electrical communication with said remote switch;

wherein said remote transmitter is in wireless communication with said indicator light assembly.

20. The system of claim 19, wherein said remote control further comprises an aperture on said hand-held device adapted to attach to a key ring.

* * * * *